US012727695B2

(12) United States Patent
Hill et al.

(10) Patent No.: US 12,727,695 B2
(45) Date of Patent: Sep. 8, 2026

(54) LID-MOUNTED FOOD AND CONDIMENT HOLDER

(71) Applicants: William Cary Hill, Blacksburg, VA (US); Ian Yentou Ho, Blacksburg, VA (US)

(72) Inventors: William Cary Hill, Blacksburg, VA (US); Ian Yentou Ho, Blacksburg, VA (US)

( * ) Notice: Subject to any disclaimer, the term of this patent is extended or adjusted under 35 U.S.C. 154(b) by 0 days.

(21) Appl. No.: 16/697,531

(22) Filed: Nov. 27, 2019

(65) Prior Publication Data

US 2020/0163478 A1 May 28, 2020

Related U.S. Application Data

(60) Provisional application No. 62/772,109, filed on Nov. 28, 2018.

(51) Int. Cl.

| | |
|---|---|
| ***A47G 23/06*** | (2006.01) |
| ***A47G 21/00*** | (2006.01) |
| ***B65D 1/36*** | (2006.01) |

(52) U.S. Cl.

CPC ..... *A47G 23/0633* (2013.01); *A47G 21/001* (2013.01); *A47G 23/0641* (2013.01); *B65D 1/36* (2013.01)

(58) Field of Classification Search

CPC ..... A47G 23/0633; A47G 23/0641; A47G 21/001; A47G 19/065

USPC ..... 220/709, 703, 705, 707, 737, 521, 574, 220/575; 206/562, 563, 505, 515

See application file for complete search history.

(56) References Cited

U.S. PATENT DOCUMENTS

| | | | | |
|---|---|---|---|---|
| 2,771,232 A * | 11/1956 | Reed | A47G 23/0641 294/159 |
| 3,944,109 A * | 3/1976 | Holz | A47G 23/0641 220/512 |
| 4,446,982 A * | 5/1984 | Corse | A21B 3/13 249/168 |
| 5,890,648 A | 4/1999 | Cai | |
| 5,954,195 A | 9/1999 | Krueger et al. | |

(Continued)

FOREIGN PATENT DOCUMENTS

KR 101448906 B1 2/2015

OTHER PUBLICATIONS

Co-pending Application No. PCT/US19/63570, International Search Report and Written Opinion dated Feb. 24, 2020, 8 pages.

(Continued)

*Primary Examiner* — Robert Poon

(74) *Attorney, Agent, or Firm* — New River Valley IP Law, P.C.; Michele L. Mayberry; Ashley M. Gates

(57) ABSTRACT

A device designed to secure a condiment, sauce, or food container on the lid of a beverage container is described. The device and its related embodiments provide a means for holding a condiment, sauce, or food container in such a manner that lateral and/or vertical movement is restricted and/or prevented to reduce the occurrence of container displacement or spillage of contents while enabling greater freedom and use of hands. The device contains features which utilize common features of a beverage container such as the straw, lid lip, or container edge to secure the device and its contents to the beverage container.

11 Claims, 8 Drawing Sheets

(56) References Cited

U.S. PATENT DOCUMENTS 6,360,885 B1 * 3/2002 Krueger ..... A47G 19/065 206/217
6,425,480 B1 * 7/2002 Krueger ..... A47G 19/065 206/217
7,185,763 B2 * 3/2007 Ali ..... A47G 19/065 220/575
7,360,666 B1 * 4/2008 Primel ..... A47G 19/065 220/759
8,105,555 B2 * 1/2012 Lahti ..... B65D 21/0206 206/564
8,573,437 B1 * 11/2013 Evans ..... A47J 45/00 220/574
8,973,776 B1 3/2015 Buck
D892,636 S * 8/2020 Troudt ..... D9/761
2001/0032791 A1 * 10/2001 Hudson ..... A47G 23/02 206/217
2002/0134781 A1 9/2002 Ciarrocchi
2006/0118453 A1 * 6/2006 Hillebrecht ..... A47G 19/065 206/562
2006/0278559 A1 * 12/2006 Hamblin ..... B65D 71/72 206/562
2007/0012754 A1 1/2007 Stier
2008/0290089 A1 11/2008 Ciarrocchi
2009/0194543 A1 8/2009 Farmer
2012/0074034 A1 * 3/2012 Bar ..... B65D 71/70 206/562
2014/0175103 A1 6/2014 Ph
2015/0182054 A1 * 7/2015 Shames ..... A47G 23/0625 206/217
2015/0216345 A1 * 8/2015 Mistler ..... B65D 5/48022 220/575
2015/0238034 A1 * 8/2015 Faulk ..... A47G 23/0633 220/737
2016/0022065 A1 * 1/2016 Bach ..... A47G 19/03 206/563

OTHER PUBLICATIONS (Hill, William Cary et al.) Co-pending Application No. PCT/US19/63570, filed Nov. 27, 2019, Specification, Claims, Figures.

* cited by examiner

FIG. 1A
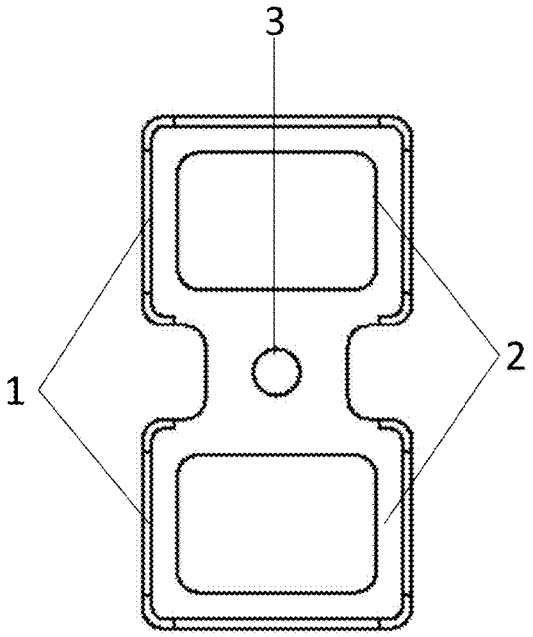
FIG. 1B
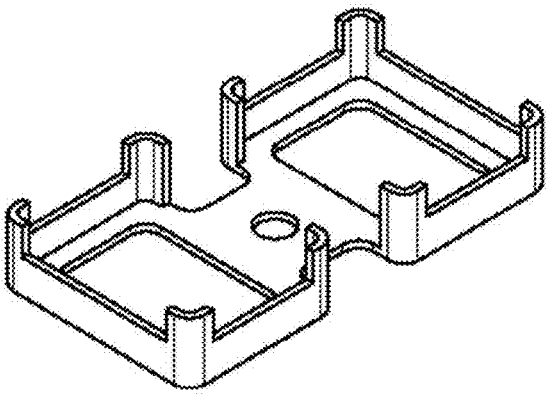
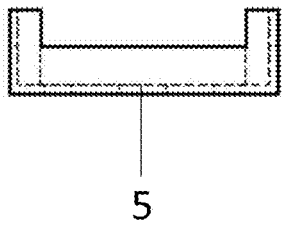
FIG. 1C
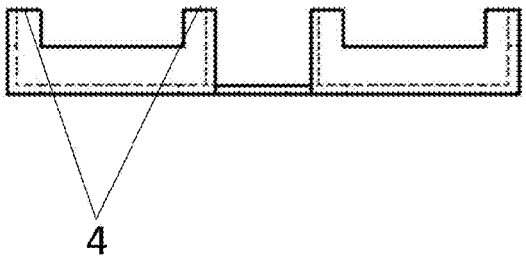
FIG. 1D

LID-MOUNTED FOOD AND CONDIMENT HOLDER

CROSS-REFERENCE TO RELATED APPLICATIONS

This application relies on the disclosure of and claims priority to and the benefit of the filing date of U.S. Provisional Application No. 62/772,109 filed Nov. 28, 2018, the disclosure of which is hereby incorporated by reference in its entirety.

BACKGROUND OF THE INVENTION

Field of the Invention

The present invention generally relates to the hands-free holding of condiment and dipping sauce containers and/or food containers (including, but not limited to, nuggets, tenders, fries, onion rings, tots, or sandwiches) as secured onto the lid of a beverage container. More particularly, embodiments of the invention exist as devices that sit on top of the beverage cup and are secured via contact with the beverage straw, edges of the cup lid, or other protrusions. The food and condiment holder may thereby secure condiments, sauces, and/or foods against unwanted movement or spillage while retaining access to the food, sauce, or condiment in a hands-free manner.

Description of Related Art

The National Highway Traffic Safety Administration (NHTSA) states that eating while driving increases the likelihood of crashes; one NHTSA study even found that both eating and reaching for a non-moving object increases the likelihood of a crash more than talking/listening to a handheld device. Odds of accident ratio were found to be 1.57 (eating) and 1.38 (reaching) versus 1.29 (talking/listening). Furthermore, drivers who elect to eat while holding dipping sauces in one hand and food to be eaten in the other necessarily drive without any hand fully and securely on the wheel, severely reducing driving ability and increasing likelihood of an accident. Reduction of driver distraction while eating and driving is one objective of this invention, as driver impairment caused by the holding of a condiment container is alleviated and the danger of condiment movement or spillage is also greatly reduced. Convenience of use and economization of space forms another motivation for this invention regardless of the location in which it is deployed.

Related art seeking to contain condiments in accessible form exist. Some products secure condiment containers to vehicle air vents or cupholders, while others clip, hang from, or modify food containers. U.S. 2002/0134781 A1 teaches a device attaching to the side of a food container to secure a condiment holder. U.S. 2008/0290089 A1 teaches a device that clips to the lip of a food container, allowing the condiment to hang beside the container. U.S. 2007/0012754 A1 and U.S. Pat. No. 5,890,648 describe modifications to the food container itself to secure condiments, and KR 101448906B1 teaches the addition of a reservoir in a beverage lid to hold condiments that are directly expunged from their original container into said reservoir. These references are each incorporated by reference herein in their entireties.

BRIEF SUMMARY OF THE INVENTION

Air-vent mounted condiment holders may actually increase driver distraction during use due to the extended distance between the condiment and the driver's mouth. Devices designed to sit in a cupholder effectively secure the condiment but preclude the cupholder from use as a beverage holder. Beverage lids of most standard sizes are not large enough to accommodate a condiment container within themselves while retaining the normal position for a straw. A more convenient, efficient, and accessible means can be accomplished using the device hereafter described.

Embodiments of the invention provide a means for securing condiments, sauces, and/or food items onto the lid of a beverage container via a device that is separate and distinct from the beverage container itself. Embodiments may also include modification of the beverage lid to accommodate the shape of the condiment or sauce container as a built-in enclosure.

By placing the apparatus on top of the beverage lid, space is economized, especially within a confined area such as a vehicle. Unwanted motion or spillage is restricted by the form of the invention, which leverages physical features common to beverage containers such as the straw or lid lip to secure the device and its enclosed condiments to reduce movement. Furthermore, as the device is designed for use with lidded beverages whereby a straw is used to drink, drinking is not inhibited during deployment of the invention, as the cup may remain relatively level during drinking and with unhindered access to the straw.

In embodiments, the device primarily consists of at least one container-holding aperture, by which food, sauce, or condiment containers or liquid forms are secured by the device, and a straw-aperture system, by which the device is attached to the straw of the beverage container to reduce lateral movement while the weight of the food, sauce, or condiment is supported by the lid of the beverage.

According to embodiments, the invention may be produced in reusable form as composed of metal, plastic, ceramic/glass, wood, or various products of paper.

According to embodiments, the invention may also be produced in single-use disposable or recyclable form from any number of materials though most likely of economy materials such as paper/cardstock/cardboard or plastic.

According to embodiments, the invention may hold one or more condiment, sauce, or food containers, or may hold a combination of condiment, sauce, or food containers, or a reservoir for expulsion of packet condiments into said reservoir.

According to embodiments, the invention may secure condiment, sauce, or food containers that are of sufficient size to hang over the edge of the beverage lid or be contained by the beverage lid.

According to embodiments, the invention may be one solid unit, collapsible, foldable, stackable, or in pieces for assembly.

While several particular embodiments are illustrated and described in this disclosure, it is contemplated that other designs accommodating a range of purposes may be developed using the same principles described herein. These embodiments and additional embodiments will be set forth in the foregoing descriptions.

BRIEF DESCRIPTION OF THE DRAWINGS

The accompanying drawings illustrate certain aspects of embodiments of the present invention and should not be used to limit the invention. Together with the written description the drawings serve to explain certain principles of the invention.

FIGS. 1A-1D are schematics of various views of one exemplary embodiment of the invention. These figures are intended to represent (but are not limited to) a possible configuration of a one-piece, reusable embodiment.

In FIGS. 1A-7, the straw-aperture system (whether a hole of any shape or a set of cuts forming bendable flaps, or other aperture) allows for securing of the device from lateral movement via the straw as it sits upon the lid of the beverage container.

In FIGS. 1A-7, the device is represented as it may be used to hold two identical containers of small size (such as a sauce or condiment container). However, any number of containers of any size may be secured within the container-holding apertures using the principles of this invention. Furthermore, one or both of the holes used to contain a condiment container may instead be fabricated to be a reservoir for holding a liquid condiment such as that expulsed from a packet.

DETAILED DESCRIPTION OF VARIOUS EMBODIMENTS OF THE INVENTION

Figure 2A:
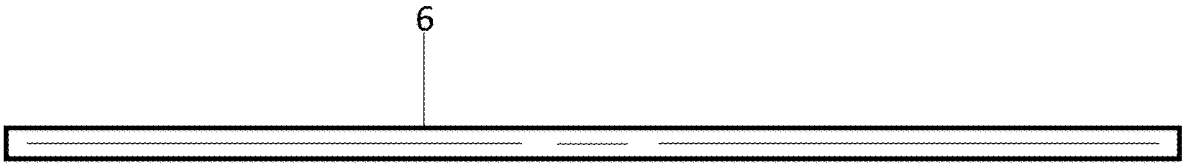
FIG. 2A is a schematic of a collapsible embodiment such as may be manufactured from plastic or cardstock (or other paper product).

Detailed reference will now be made to various exemplary embodiments of the invention. This discussion is not intended to limit the scope or prospective embodiments of the invention; rather, this discussion is intended to provide a deeper understanding of the novel aspects and features of the invention. This disclosure covers preferred embodiments of the instant invention. Other modifications and variations of the preferred embodiments can be readily contemplated by those skilled in the art. For example, the number of container-holding apertures within the device is not limited to two, nor are the containers limited to lie completely on, or overlie the lid of the beverage container. The flaps for the container-holding apertures may be designed to hold containers of the same and/or different sizes, shapes, and/or dispositions. All of these and other variations of the preferred embodiments are rightly included in the present invention.

Aspects of the invention include a device comprising: a support with a first aperture capable of receiving a straw protruding from a lid of a beverage container in a manner that restricts lateral movement of the support relative to the lid; wherein the support further comprises one or more second aperture each shaped and sized for receiving a container and/or one or more wells for retaining a dispensed product; wherein during use the support, and/or the container(s) and/or one or more of the wells is capable of contacting the lid of the beverage container in a manner capable of supporting the weight of the support, container(s) and/or well(s).

Embodiments include the device of Aspect 1, wherein the lateral movement of the support is restricted to an extent that allows for the support to move a maximum distance of up to about 1%, 3% 5%, 7%, 10%, 12%, 15%, 18%, 20%, 25%, 30%, 35%, 40%, 45%, or 50% of the diameter/width of the lid.

Additionally, embodiments include the device of any preceding Aspect, wherein during use the lid of the beverage container and/or interaction between the straw and the support are capable of supporting the container(s) and/or well(s) against vertical movement.

In embodiments, the invention includes the device of any preceding Aspect. wherein the device comprises one or more rigid material, such as one or more material chosen from one or more of plastic, metal, ceramic, glass, paper, cardstock, cardboard, wood and combinations thereof.

Aspects of the invention include, the device of any preceding Aspect, which is designed as a single, solid unit; or which is designed to fold, collapse, or otherwise assemble from a more compact or piece-wise form.

Embodiments include the device of any preceding Aspect, wherein during use the support is capable of sitting upon the lid of the beverage container and uses the straw, lid, container edge, or other structural feature as an anchor point to which the support and its contents are secured from significant movement.

Aspects also include the device of any preceding Aspect, wherein the container is a condiment, sauce, or food container which is capable of being supported by a bottom of the condiment, sauce, or food container while being secured to the beverage lid by one or more mechanisms of the support.

Embodiments of the invention further include, the device of any preceding Aspect, wherein during use a condiment, sauce, or food is capable of being directly placed within one or more of the wells.

Aspects include the device of any preceding Aspect, wherein during use one condiment, sauce, or food is capable of being secured onto the lid of the beverage container, and/or wherein during use multiple condiments, sauces, or foods are capable of being secured onto the lid of the beverage container.

The invention includes Aspects such as the device of any preceding claim, wherein one or more of the second apertures are shaped and sized to accommodate a specific condiment, sauce, or food container.

Aspects include the device of any preceding Aspect, wherein one or more of the second apertures have a complementary shape and size to that of the specific condiment, sauce, or food container, and/or wherein one or more of the second apertures are shaped and sized to accommodate a range of different shaped and sized condiment, sauce, or food containers.

In Aspects, embodiments include the device of any preceding claim, wherein the support is separate and distinct from the lid of the beverage container.

Also included in Aspects, embodiments include the device of any preceding claim, wherein the support is built into the lid of the beverage container.

According to embodiments of the device described, a material is molded, stamped, pressed, extruded, or otherwise fabricated in order to make a shape that stands freely upon the lid of a beverage container, or forms the lid of the beverage container itself. According to embodiments, the device contains container-holding apertures or reservoirs for holding and securing condiment and dip containers or condiments and dips in liquid form. According to embodiments, if the device is a distinct unit, separate from the beverage lid itself, it may be secured to the lid through the straw-aperture system, in contact with the beverage straw, cup, and/or lid.

According to embodiments of the invention, the device may be manufactured as a robust, reusable device intended for multiple uses over time. It may be composed of metal, ceramic, plastic, wood, paper, or any combination thereof as well as any other material deemed suitable for the application.

According to embodiments of the invention, the device may be manufactured in bulk from commodity materials such as plastic and paper products in a stackable form for mass distribution through food service venues, drive thrus, and others.

According to embodiments of the invention, the holes or reservoirs may be designed to hold a wide variety of sauce or condiment container configurations (i.e. as a universal condiment holder), or be designed to the specific dimensions of sauce or condiment containers supplied by a particular restaurant, chain, franchise, or other establishment.

According to embodiments of the invention, the device may facilitate the holding of any number of sauce or condiments or sauce or condiment containers. The illustrated embodiments demonstrate the securing of two containers simultaneously, as may be preferred for sake of balance, but any number of condiments or sauces may be accommodated, from 1-10 or more.

The present invention differs from other inventions which include a reservoir built into the beverage lid for condiment containment in that the invention provides a means for securing the condiment container itself, such as a dipping sauce container, thereby facilitating more rapid and more hygienic deployment of and access to condiments. Furthermore, as the invention is intended for use with beverages utilizing a drinking straw, the beverage does not need to be tipped during drinking, preventing spilling of the condiments secured above the device.

The present invention differs from other inventions which include a holder to secure condiments and dipping sauce containers within the food carton itself in that the device is intended for attachment to the lid of an accompanying beverage.

The present invention differs from other inventions which embody a sleeve or clip that attaches to food or beverage containers for the purpose of holding condiments in that the current invention secures the condiments to the lid of the beverage container, thereby employing gravity and contact with the straw and cup lid to more securely hold the containers as well as allowing use of a cupholder, which may be precluded by the use of a sleeve.

Detailed descriptions of the preferred embodiments follow. These descriptions are not to limit the scope of the present invention, but serve to describe several envisioned embodiments in greater detail.

FIGS. 1-5 show various configurations of holes or reservoirs 1, 9, 11, 17, 20, 26 which may be used to hold or secure condiment and sauce containers or liquid condiments or sauces themselves.

FIG. 1A shows exemplary cutouts 2, 4 by which material may be excluded from production for reduction of cost and weight.

FIGS. 1-5 illustrate the straw-aperture system comprising of holes of any shape 3, 10, 13, 18, 21, or slits 28, through which aperture a drinking straw may be passed through the device to secure it from lateral and vertical movement. For example, in embodiments lateral movement of the support can be restricted to an extent that allows for the support to move a maximum distance of up to about 1%, 3% 5%, 7%, 10%, 12%, 15%, 18%, 20%, 25%, 30%, 35%, 40%, 45%, or 50% of the diameter/width of the lid. In the same or different embodiments, vertical movement of the support and/or the containers retained/held/supported by the support can be restricted to an extent that allows for the containers to move a maximum distance of up to about 1%, 3% 5%, 7%, 10%, 12%, 15%, 18%, 20%, 25%, 30%, 35%, 40%, 45%, or 50% of the length of the exposed/protruding portion of the straw. In preferred embodiments, lateral movement of the support and/or containers during use is restricted to a maximum distance of up to about 1%, 3% 5%, 7%, 10%, 12%, 15%, 18%, or 20% of the diameter/width of the lid, while vertical movement of the support and/or containers during use is restricted to a maximum distance of up to about 1%, 3% 5%, 7%, 10%, 12%, 15%, 18%, or 20% of the length of the exposed/protruding portion of the straw, especially in the direction toward the lid. In embodiments, restriction of vertical movement in a direction away from the lid can be unlimited (allowing for the support to be removed from the straw/lid) or can be limited by the length of the exposed/protruding portion of the straw. Any hole shape or slit configuration may be used with any configuration of device without limit.

Figure 6:
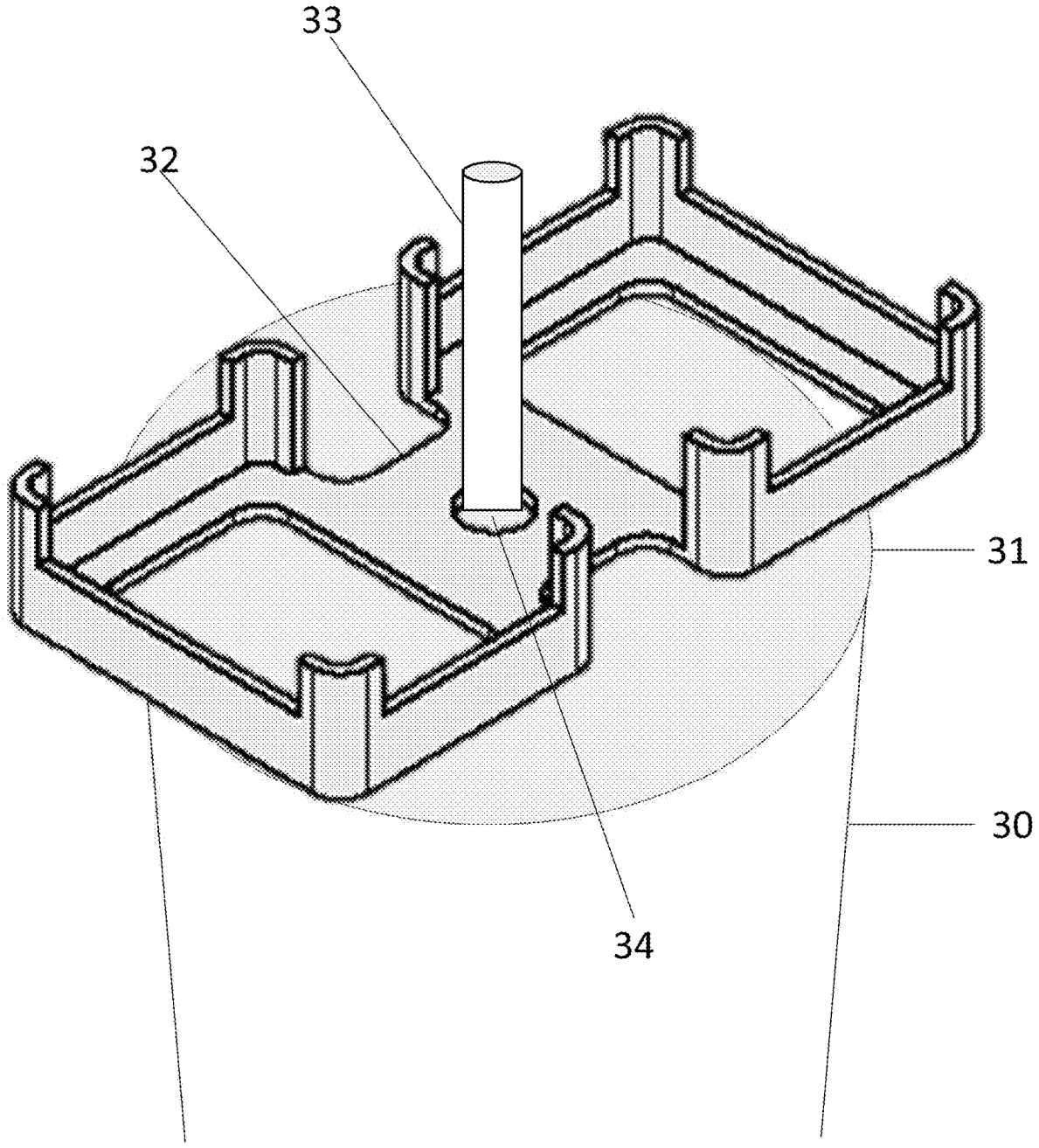
FIG. 6 is an illustration of the embodiment in FIGS. 1A-1D in its intended use upon the lid of a beverage container.

FIGS. 1 and 6 show how a device may support a sauce container or serve as a condiment reservoir 5, 32, supported by the lid of a beverage container.

Figure 2B:
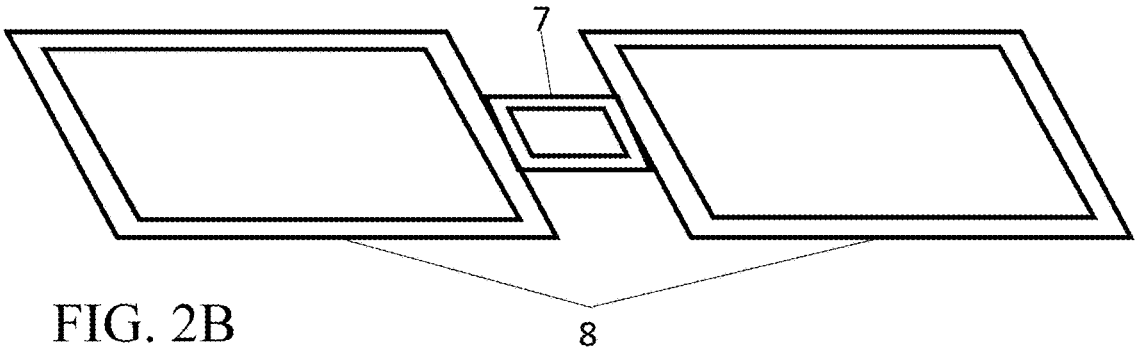
FIG. 2B is a schematic which illustrates the collapsed item of FIG. 2A as it is unfolding.
Figure 2C:
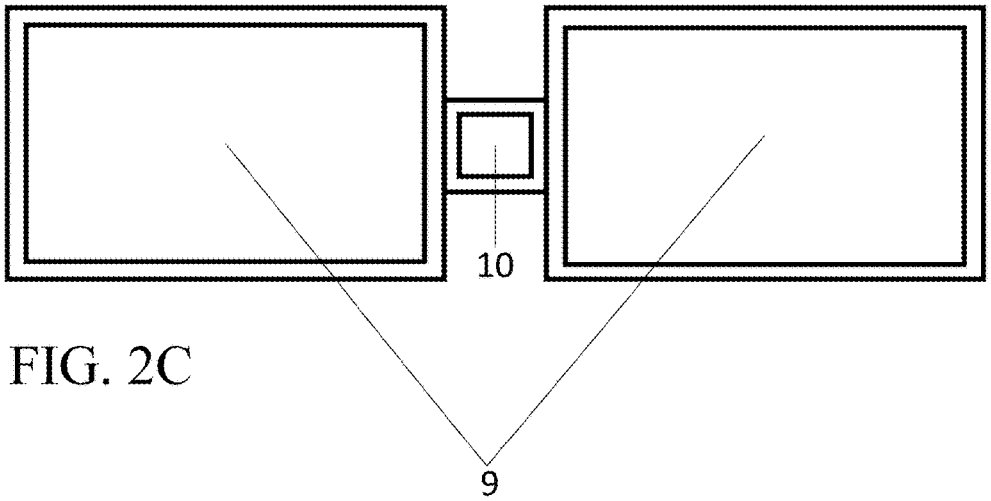
FIG. 2C is a schematic which represents the opened form of the embodiment of FIGS. 2A-B as, in this particular rendering, it is prepared to hold two similar or identically-sized containers, such as condiment containers.

FIG. 2 demonstrates how a collapsible embodiment may be stored in folded form 6, with reservoir and straw openings expanding 7, 8 into functional form.

Figure 3A:
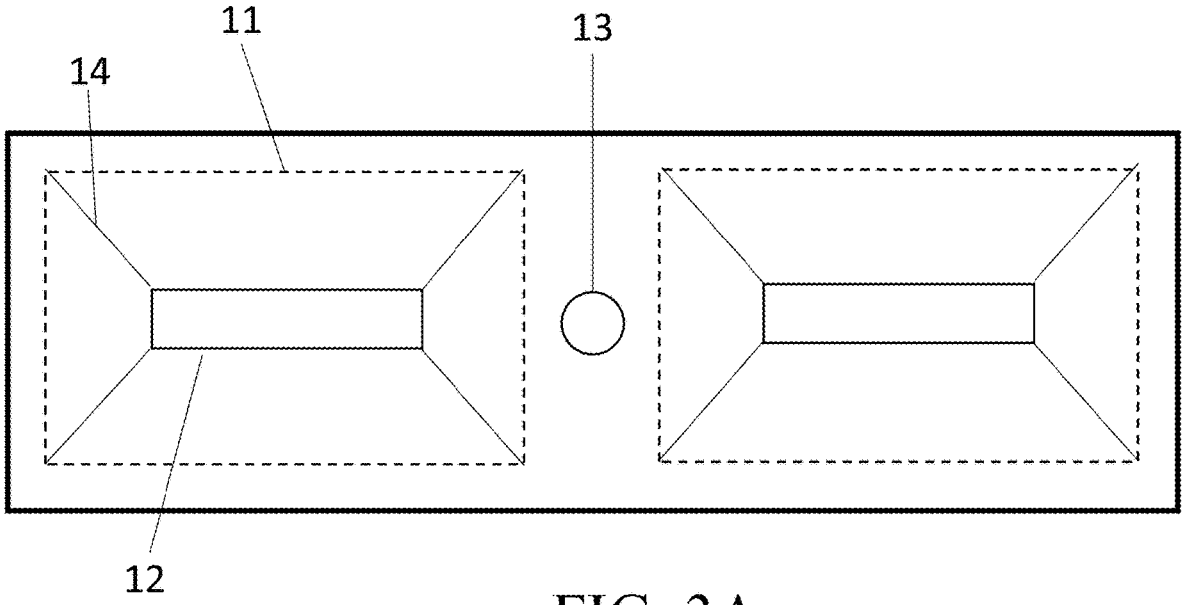
FIG. 3A is a schematic that represents another exemplary embodiment made from a single sheet of plastic or cardstock or other paper product. Solid lines represent pre-cut features, while dashed lines represent pre-folded features or where the product can be folded for use. In this illustration, food, condiment or dip containers may be pushed through the container-holding apertures, where the pre-cut and pre-folded lines open to form a pocket for the condiment container.
Figure 3B:
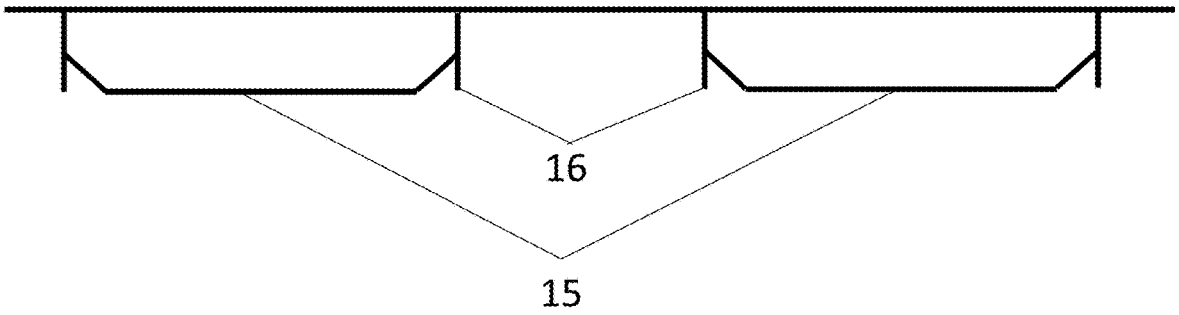
FIG. 3B is a schematic showing a side elevation view of an embodiment similar to that shown in FIG. 3A, with the pre-cut and pre-folded features in an active position.

FIG. 3 demonstrates how a collapsible embodiment may be produced and distributed as a flat sheet with pre-folded creases 11 to encourage retention of shape as flaps 14, 16 are folded back along these creases upon insertion of the sauce or condiment container. The flaps may be cut 12 so that the flaps and sauce containers 15 are of approximately equivalent height.

FIGS. 3-4 demonstrate how the weight of the sauce or condiment containers may be supported by the sauce or condiment containers themselves 15, 19, 24 upon the lid of the beverage by means of being the lowest protrusion within the device. Alternatively, the solid and dotted lines shown by 11, 12, and 14 can form a well for holding a condiment that is poured into the well, such as from a mustard, mayonnaise, or ketchup packet.

Figure 4A:
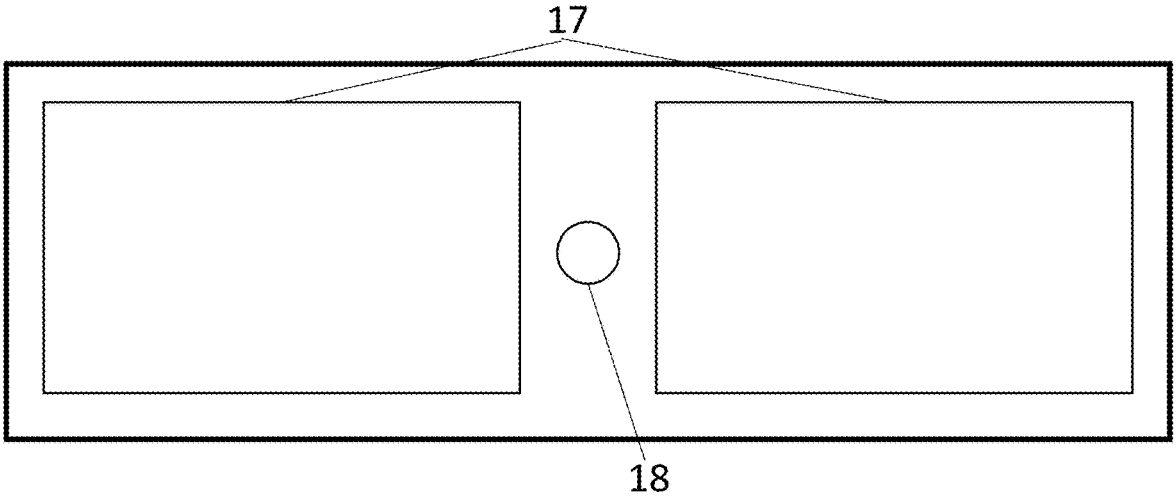
FIGS. 4A-4B are schematics that represent another exemplary embodiment made from a thin plastic.
Figure 4B:
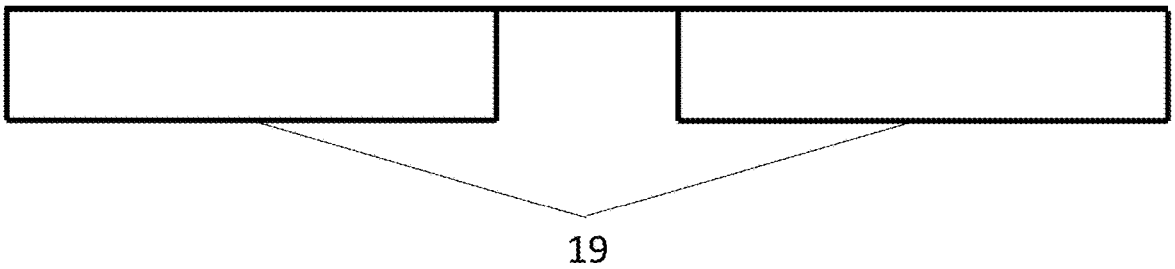
Figure 4C:
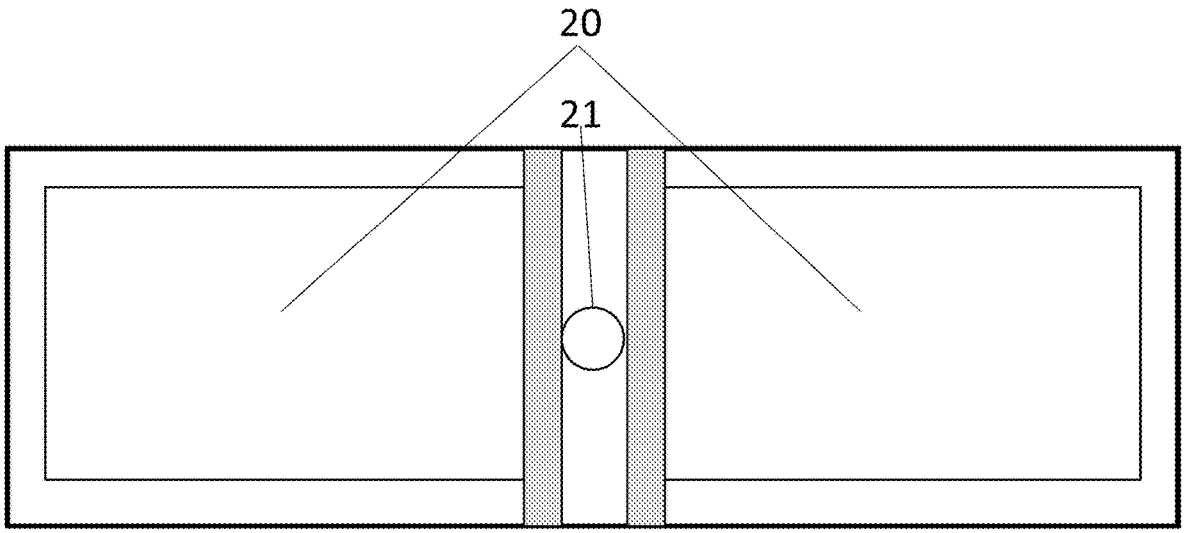
FIGS. 4C and 4D are schematics that represent a form made from a single sheet that is angled to support the top of the condiment containers, whereas the condiment containers (dashed line) support the weight of the unit.
Figure 4D:
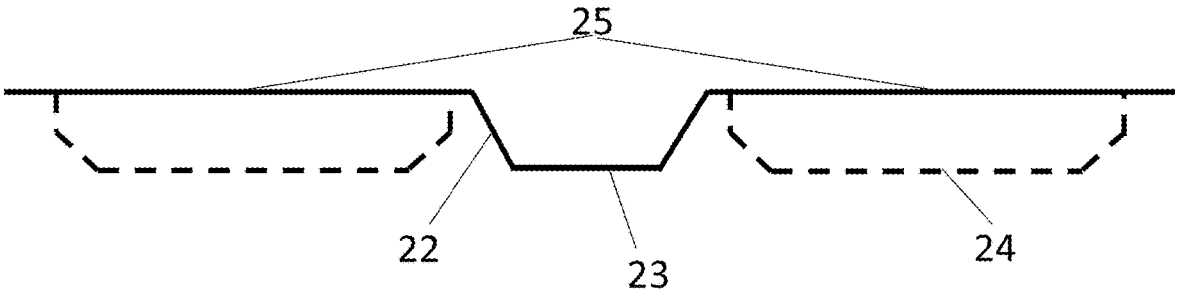
Figure 5A:
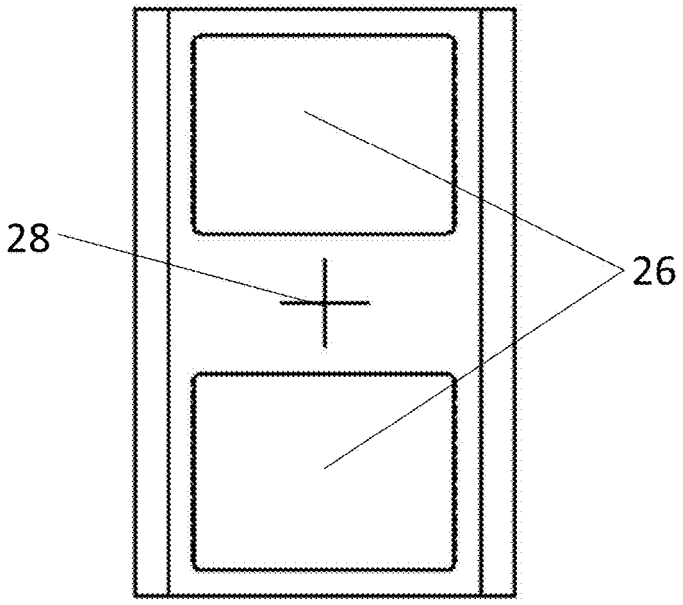
FIGS. 5A-5D are schematics that represent another exemplary embodiment made from thin plastic, that can be stackable and distributable in bulk in a sleeve. The central cross represents slits through which the beverage straw may pass to secure the device and its attached condiments, while the legs of the device are supported by the cup lid.
Figure 5B:
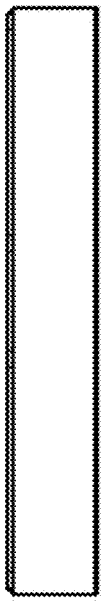
Figure 5C:
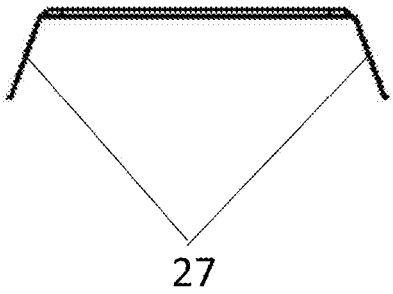
Figure 5D:
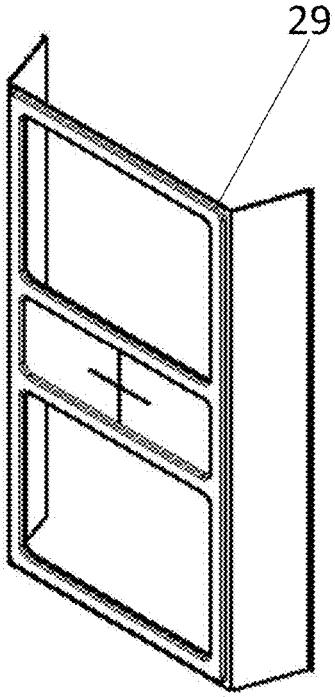

FIG. 4D illustrates an embodiment that may use a tapered region 22 to contact the beverage lid 23 while securing the condiment or sauce containers from lateral movement through contact with the enclosing region of the device 25 and contact of the device with the beverage straw 21.

FIG. 5 illustrates how a thin material (such as, but not limited to, polyvinyl chloride, low density or high density polyethylene, or other material) may be designed in stackable form with tapered legs 27 and embossment 29 for added strength.

Figure 7:
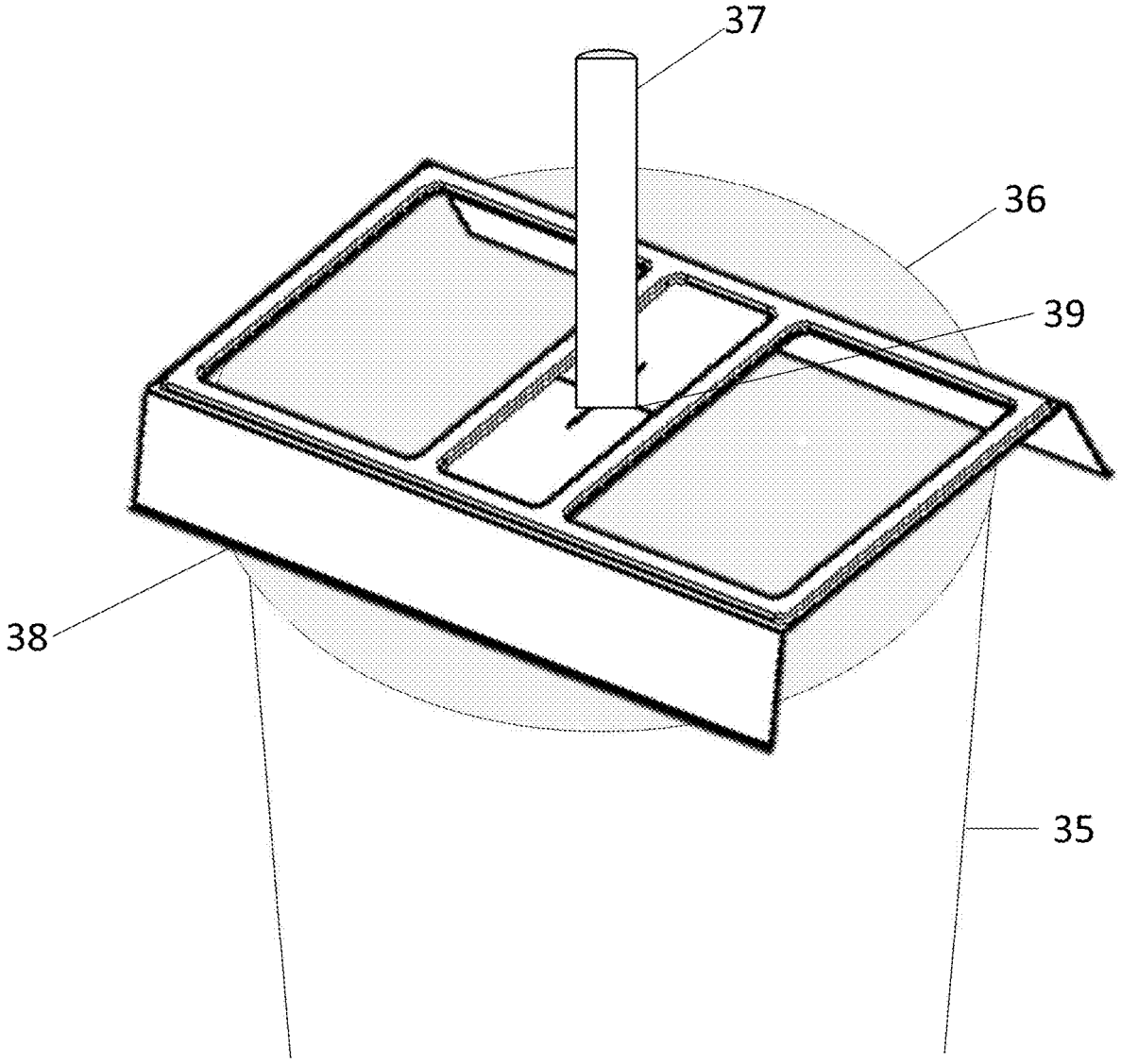
FIG. 7 is an illustration of the embodiment in FIGS. 5A-5D in its intended use upon the lid of a beverage container.

FIGS. 6-7 illustrate how two of the envisioned embodiments may be deployed on a beverage cup 30, 35, using the beverage lid 31, 36 and straw 33, 37 to secure the device from unwanted lateral and vertical movement through contact 34, 39 with one or more of these surfaces.

The present invention has been described with reference to particular embodiments having various features. In light of the disclosure provided above, it will be apparent to those skilled in the art that various modifications and variations can be made in the practice of the present invention without departing from the scope or spirit of the invention. One skilled in the art will recognize that the disclosed features may be used singularly, in any combination, or omitted based on the requirements and specifications of a given application or design. When an embodiment refers to "comprising" certain features, it is to be understood that the embodiments can alternatively "consist of" or "consist essentially of" any one or more of the features. Other embodiments of the invention will be apparent to those skilled in the art from consideration of the specification and practice of the invention.

It is noted in particular that where a range of values is provided in this specification, each value between the upper and lower limits of that range is also specifically disclosed. The upper and lower limits of these smaller ranges may independently be included or excluded in the range as well. The singular forms "a," "an," and "the" include plural referents unless the context clearly dictates otherwise. It is intended that the specification and examples be considered as exemplary in nature and that variations that do not depart from the essence of the invention fall within the scope of the invention. Further, all of the references cited in this disclosure are each individually incorporated by reference herein in their entireties and as such are intended to provide an efficient way of supplementing the enabling disclosure of this invention as well as provide background detailing the level of ordinary skill in the art.

The invention claimed is:

1. A device comprising:

a support comprising a top surface with a first aperture, the first aperture configured in a manner capable of receiving a straw protruding from a lid of a beverage container in a manner such that engagement between the straw and the support restricts lateral movement of the support relative to the lid;

wherein the top surface further comprises two second apertures each shaped and sized for receiving a container;

wherein the two second apertures are disposed on opposing sides of the first aperture;

wherein the support is rectangular and comprises an outer rim defined by two short sides and two long sides of the device;

wherein the top surface further comprises an area of continuous solid support disposed between the two second apertures such that a line, parallel to the long sides of the device and extending between the two second apertures, passes through the area of continuous solid support;

wherein the top surface further comprises an embossment that is i) concentric to each of the two second apertures, the outer rim, and the area of continuous solid support and ii) raised relative to the area of continuous solid support;

wherein the support further comprises a first leg disposed on or along a first long side of the device and a second leg, disposed on or along a second long side of the device;

wherein the first and second legs extend downwards and outwards at an angle from each of the first and second long sides of the device such that the device may be stacked with a second device; and wherein a plan view of the support shows no feature of the device disposed under the apertures.

2. The device of claim 1, further comprising:

a side support section disposed on a side of each of the second apertures and forming a portion of the outer rim of the device;

wherein the central support section has a surface area that is greater than a surface area of either of the side support sections.

3. The device of claim 1, comprising a rigid material chosen from one or more of plastic, metal, ceramic, glass, paper, cardstock, cardboard, wood and combinations thereof.

4. The device of claim 1, wherein the device is configured as a single, solid unit or is configured to fold, collapse, or otherwise assemble from a more compact or piece-wise form.

5. The device of claim 1, wherein one or more of the second apertures are shaped and sized to accommodate a range of different shaped and sized condiment, sauce, or food containers.

6. The device of claim 1, wherein the first and second legs are rectangular.

7. The device of claim 1, wherein the first aperture is disposed in the center of the top surface.

8. The device of claim 7, wherein the second and third apertures are disposed equidistantly from each of the first and second long sides of the support.

9. The device of claim 1, wherein the first aperture is smaller than the two second apertures.

10. The device of claim 1, wherein the first aperture is disposed:

equidistantly from the first and second long sides of the support; and equidistantly from the first and second short sides of the support.

11. The device of claim 1, wherein the embossment comprises a planar upper surface that lies in a plane disposed above the area of continuous solid support.

* * * * *